US007388594B2

(12) United States Patent
Kim et al.

(10) Patent No.: US 7,388,594 B2
(45) Date of Patent: Jun. 17, 2008

(54) ELECTROSTATIC LATENT IMAGE FORMING MEDIUM, IMAGE FORMING APPARATUS INCLUDING THE ELECTROSTATIC LATENT IMAGE FORMING MEDIUM AND METHOD OF FORMING AN ELECTROSTATIC LATENT IMAGE

(75) Inventors: Seong-jin Kim, Seongnam-si (KR); Seung-joo Shin, Seoul (KR); Kye-si Kwon, Seoul (KR); Jang-yeon Kwon, Seongnam-si (KR); Il-kwon Moon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 442 days.

(21) Appl. No.: 11/131,238

(22) Filed: May 18, 2005

(65) Prior Publication Data

US 2005/0259140 A1 Nov. 24, 2005

(30) Foreign Application Priority Data

May 19, 2004 (KR) ..... 10-2004-0035548

(51) Int. Cl.
*B41J 2/41* (2006.01)

(52) U.S. Cl. ..... 347/141

(58) Field of Classification Search ..... 347/141, 347/142

See application file for complete search history.

(56) References Cited

U.S. PATENT DOCUMENTS

| | | | | |
|---|---|---|---|---|
| 4,448,867 | A | 5/1984 | Ohkubo et al. | |
| 4,620,203 | A * | 10/1986 | Nakatani et al. | 347/112 |
| 5,640,189 | A | 6/1997 | Ohno et al. | |
| 6,100,909 | A * | 8/2000 | Haas et al. | 347/141 |
| 6,760,051 | B2 * | 7/2004 | Fujii et al. | 347/141 |

FOREIGN PATENT DOCUMENTS

| | | |
|---|---|---|
| EP | 1 000 741 | 5/2000 |

* cited by examiner

*Primary Examiner*—Huan H Tran
(74) *Attorney, Agent, or Firm*—Lee & Morse, P.C.

(57) ABSTRACT

An electrostatic latent image forming medium includes a frame, an imaging surface on which an electrostatic latent image is to be formed, the imaging surface being supported by the frame, and an alteration mechanism for altering the electrostatic latent image on the imaging surface, the alteration mechanism being between the frame and the imaging surface. When signals are selectively applied to the alteration mechanism, an electrostatic latent image with a potential different from a potential of its surrounding area is formed on the imaging surface.

20 Claims, 5 Drawing Sheets

ELECTROSTATIC LATENT IMAGE FORMING MEDIUM, IMAGE FORMING APPARATUS INCLUDING THE ELECTROSTATIC LATENT IMAGE FORMING MEDIUM AND METHOD OF FORMING AN ELECTROSTATIC LATENT IMAGE

BACKGROUND OF THE INVENTION

1. Field of the Invention

The present invention relates to an electrostatic latent image forming medium, an image forming apparatus, and a method of forming an electrostatic latent image. More particularly, the present invention relates to an electrostatic latent image forming medium that forms an electrostatic latent image by controlling electrodes under an imaging surface, e.g. using an array of thin film transistors (TFTs), an image forming apparatus transferring a desired image from the electrostatic latent image, and a method of forming the image.

2. Description of the Related Art

In general, an electrophotographic image forming apparatus, e.g., a copier, a laser printer, or a facsimile, prints an image by forming an electrostatic latent image on a photosensitive medium, e.g., a photosensitive drum or a photosensitive belt, using a laser scanning unit (LSU), developing the electrostatic latent image using a developing agent having a predetermined color, and transferring the developed image onto a tangible medium, e.g., a sheet of paper.

FIG. 1 illustrates a schematic view of a conventional electrophotographic image forming apparatus including an LSU 10, a photosensitive drum 20 on which an electrostatic latent image is formed by the LSU 10 scanning a laser beam onto a surface thereof, and a toner supplying roller 30 supplying toner to the electrostatic latent image formed on the surface of the photosensitive drum 20.

The LSU 10 includes a laser diode (LD) 11 emitting a laser beam, a polygonal mirror 12 scanning the laser beam emitted from the LD 11, a focusing lens 13 focusing the laser beam reflected by the polygonal mirror 12, and a mirror 14 reflecting the laser beam that passed through the focusing lens 13 to form an electrostatic latent image on the surface of the photosensitive drum 20.

When the LSU 10 scans a laser beam onto the surface of the photosensitive drum 20 charged with a predetermined potential, electric charges in a portion of the surface of the photosensitive drum 20 onto which the laser beam is scanned disappear. Therefore, an electrostatic latent image with a potential different from potentials of other portions of the surface of the photosensitive drum 20 is formed in the portion onto which the laser beam is scanned. Toner supplied by the toner supplying roller 30 is selectively adhered to the electrostatic latent image by an electrostatic force. Thus, the electrostatic latent image develops into a desired image. The developed image on the surface of the photosensitive drum 20 is transferred to a sheet of print paper P, and then fixed on the sheet of print paper P by a fixing unit (not shown).

Since the LSU 10 has a complicated structure, the use thereof increases the size and manufacturing cost of the conventional image forming apparatus. In addition, since the LSU 10 scans a laser beam while the polygonal mirror 12 is rotated by a motor (not shown), it is difficult to increase a printing speed by reducing the time needed for scanning the laser beam.

SUMMARY OF THE INVENTION

The present invention is therefore directed to an electrostatic latent image forming medium, an image forming apparatus including the same, and a method of forming the image, which substantially overcome one or more of the problems due to the limitations and disadvantages of the related art.

It is a feature of an embodiment of the present invention to provide an image forming apparatus including the electrostatic latent image forming medium and an image forming method which have a fast printing speed.

It is another feature of an embodiment of the present invention to provide an image forming apparatus including the electrostatic latent image forming medium and an image forming method having high resolution.

It is still another feature of an embodiment of the present invention to provide an image forming apparatus having reduced size.

At least one of the above and other features and advantages of an embodiment of the present invention may be realized by providing an image forming apparatus, including an electrostatic latent image forming medium having a frame, an imaging surface on which an electrostatic latent image is to be formed, the imaging surface being supported by the frame, and an alteration mechanism for altering the electrostatic latent image on the imaging surface, the alteration mechanism being between the frame and the imaging surface, a signal supply for supplying a signal to the alteration mechanism in accordance with the electrostatic latent image to be formed, and a transfer unit for transferring the electrostatic latent image to a printing medium.

The image forming apparatus may further include a charging unit for charging the imaging surface with a predetermined potential. The electrostatic latent image forming medium may be a drum or a belt.

At least one of the above and other features and advantages of an embodiment of the present invention may be realized by providing an electrostatic latent image forming medium, including a frame, an imaging surface on which an electrostatic latent image is to be formed, the imaging surface being supported by the frame, and an alteration mechanism for altering the electrostatic latent image on the imaging surface.

The alteration mechanism may include a plurality of pixel electrodes adjacent to the imaging surface. A number of pixel electrodes in the plurality of pixel electrodes may correspond to a desired resolution of the electrostatic latent image. The alteration mechanism may include a thin film transistor array on a surface of the frame, the thin film transistor array including a plurality of thin film transistors, and a capacitor layer formed on the thin film transistor array, the capacitor layer including a common electrode and a dielectric layer stacked on the common electrode, wherein the plurality of pixel electrodes is arranged on a surface of the dielectric layer and each pixel electrode is connected to a drain of a corresponding thin film transistor of the plurality of thin film transistors.

Sources of the thin film transistors may be grounded. The alteration mechanism may further include a supply line for supplying a voltage to a gate of a thin film transistor to electrically connect a source with a drain of the selected thin film transistor and discharge the pixel electrode connected to the drain of the thin film transistor.

The alteration mechanism may further include a gate supply line for supplying a gate voltage to a gate of a thin film transistor and a source supply line for supplying a source voltage to a source of the thin film transistor, the gate and source voltages injecting electric charges to the pixel electrode connected to the drain of the thin film transistor.

The common electrode may be grounded and formed as a layer covering an entire bottom surface of the dielectric layer. A protective layer on a surface of the capacitor layer. The protective layer may be formed of an abrasion resistant material. The frame may be cylindrical or a belt.

At least one of the above and other features and advantages of an embodiment of the present invention may be realized by providing a method of forming an image, including selectively applying a signal to selected pixel electrodes of a plurality of pixel electrodes, the plurality of pixel electrodes under an imaging surface on which an electrostatic latent image is to be formed, the selectively applying being in accordance with the electrostatic latent image to be formed, and transferring the electrostatic image to a printing medium.

The method of forming an image may further include charging the imaging surface with a predetermined potential before the selectively applying the signal. The selectively applying the signal may include discharging the selected pixel electrodes or charging the selected pixel electrodes.

BRIEF DESCRIPTION OF THE DRAWINGS

The above and other features and advantages of the present invention will become more apparent to those of ordinary skill in the art by describing in detail exemplary embodiments thereof with reference to the attached drawings in which:

FIG. 4 illustrates a cross-sectional view of the rotating drum before an electrostatic latent image is formed thereon. FIG. 5 illustrates a cross-sectional view of the rotating drum after an electrostatic latent image is formed thereon; FIG. 6 illustrates a cross-sectional view of the rotating drum before an electrostatic latent image is formed thereon. FIG. 7 illustrates a cross-sectional view of the rotating drum after an electrostatic latent image is formed thereon.

DETAILED DESCRIPTION OF THE INVENTION

Figure 1:
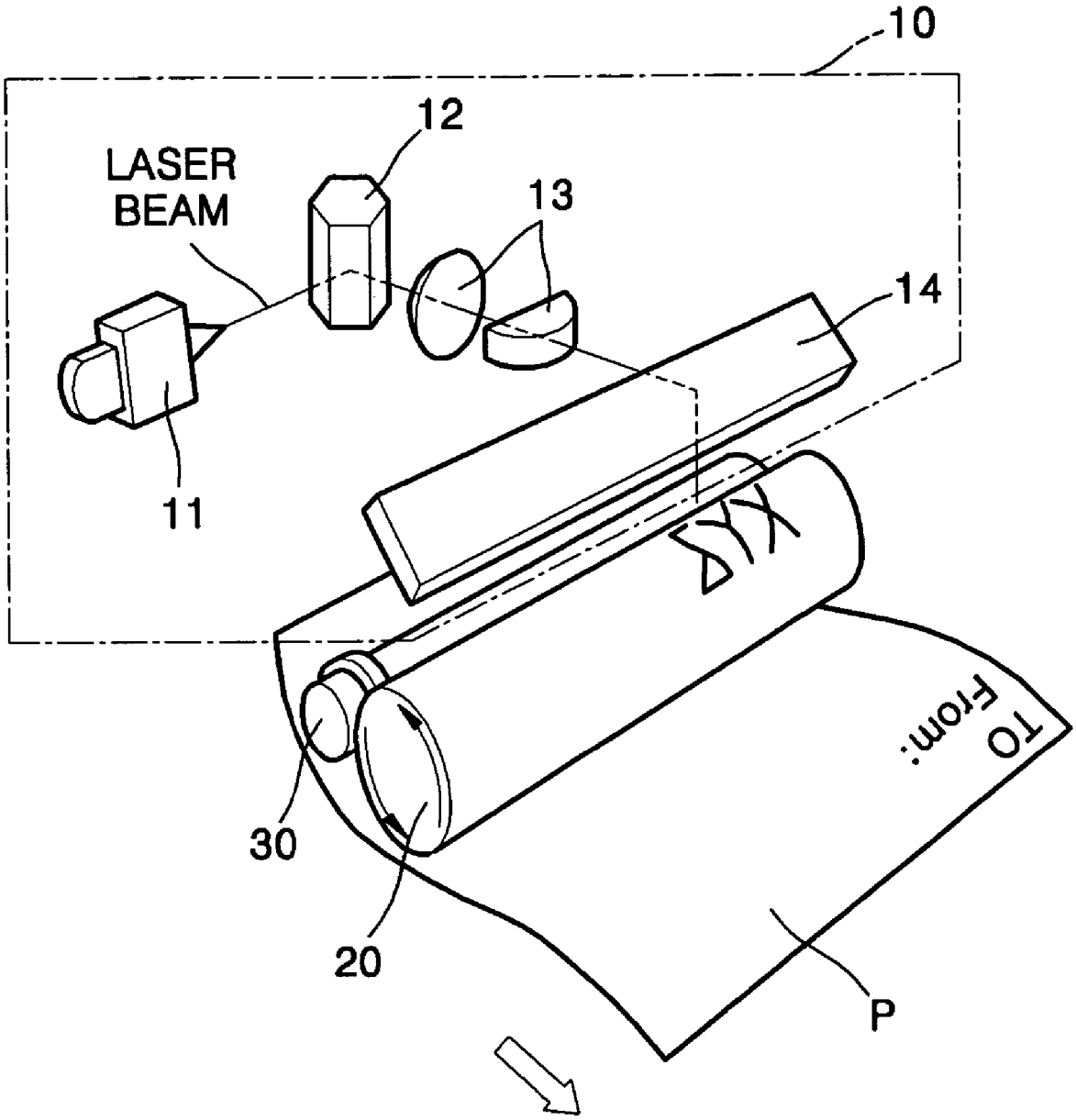
FIG. 1 (PRIOR ART)
FIG. 1 illustrates a schematic view of a conventional electrophotographic image forming apparatus including a laser scanning unit (LSU)

This application claims the priority of Korean Patent Application No. 10-2004-0035548, filed on May 19, 2004, in the Korean Intellectual Property Office, the disclosure of which is incorporated herein in its entirety by reference.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
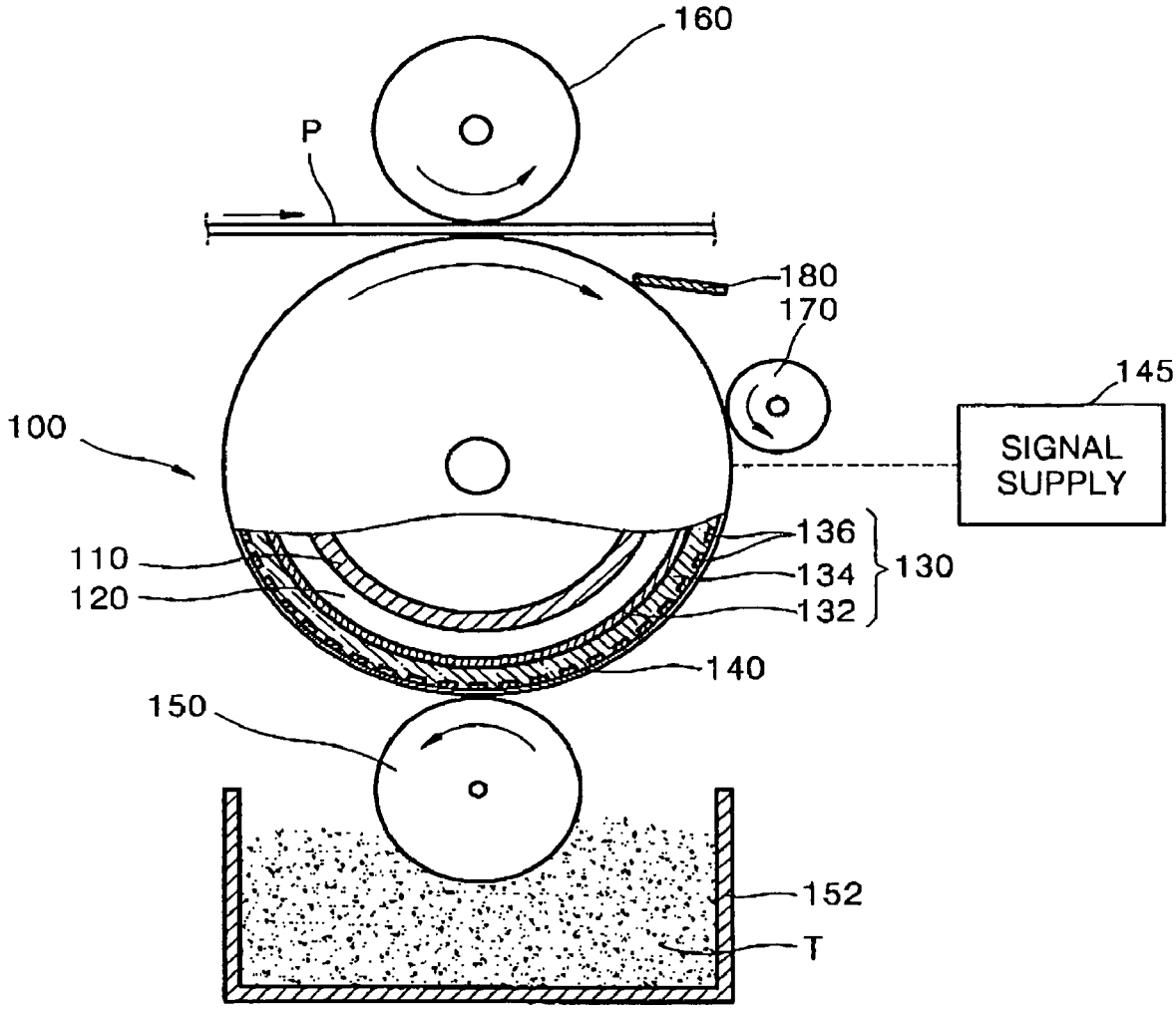
FIG. 2 illustrates a schematic view of an image forming apparatus according to an embodiment of the present invention.
Figure 3A:
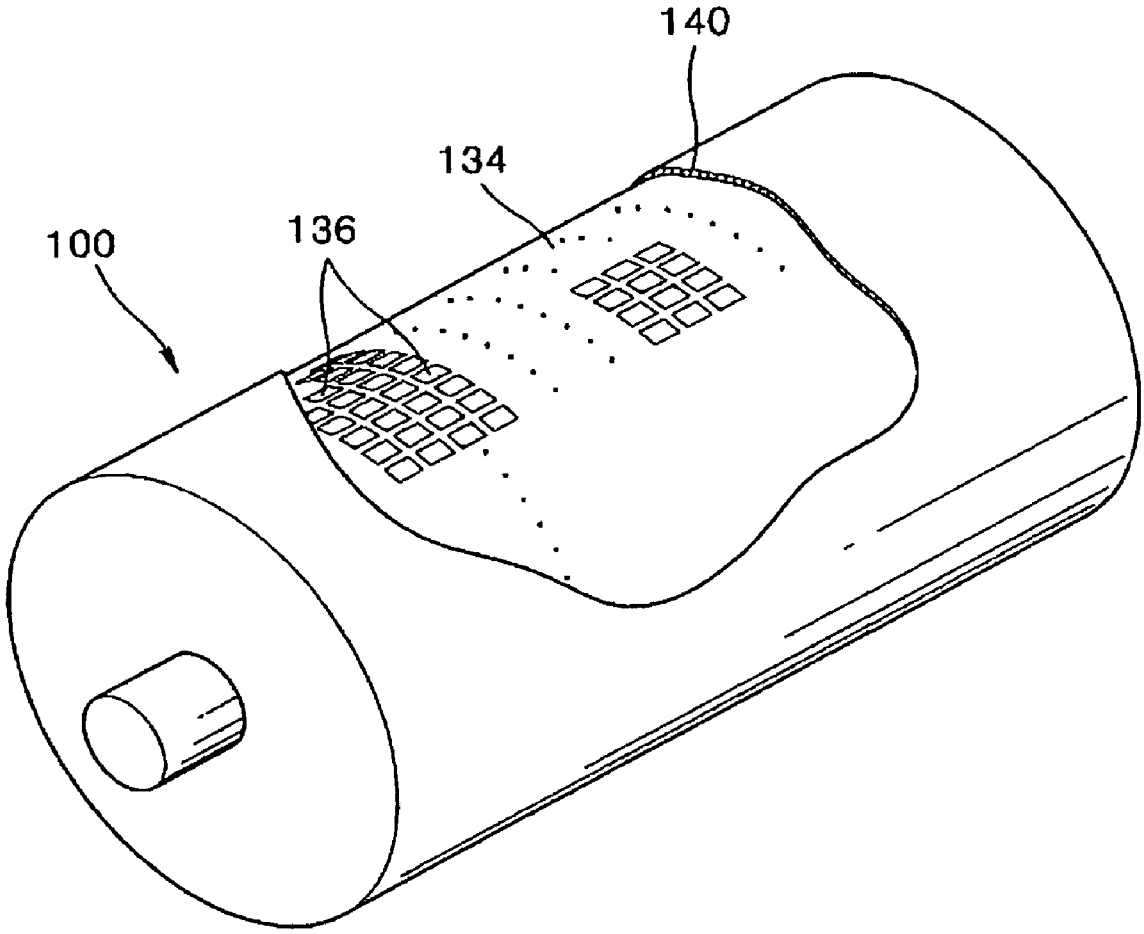
FIG. 3A illustrates a perspective view of a rotating drum as an electrostatic latent image forming medium illustrated in FIG. 2.

FIG. 2 illustrates a schematic view of an image forming apparatus according to an embodiment of the present invention. FIG. 3A illustrates a perspective view of a drum 100 as an electrostatic latent image forming medium illustrated in FIG. 2.

Referring to FIG. 2, the image forming apparatus includes an electrostatic latent image forming medium, a toner supplying unit, and a transferring unit. The image forming apparatus may further include a charging unit, depending on how an electrostatic latent image is formed. The electrostatic latent image forming medium forms an electrostatic latent image that corresponds to an image to be printed.

The drum 100 includes a thin film transistor (TFT) array 120 and a capacitor layer 130 stacked sequentially on a surface of a cylindrical frame 110. The TFT array 120 is stacked on the surface of the frame 110 and includes a plurality of TFTs 122*a* and 122*b*, shown in FIG. 4. The capacitor layer 130 includes a common electrode 132 formed on the TFT array 120, a dielectric layer 134 formed on the common electrode 132, and a plurality of pixel electrodes 136 arranged on a surface of the dielectric layer 134. The number of the pixel electrodes 136 depends on the degree of resolution required by the image forming apparatus. In other words, the number of the pixel electrodes 136 is the same as the number of pixels of an image.

An array of the pixel electrodes 136 is formed on the surface of the dielectric layer 134, as illustrated in FIG. 3A. The pixel electrodes are adjacent an imaging surface of the rotating drum 100. A signal supply 145, shown in FIG. 2, supplies a signal to control the electrostatic latent image on the imaging surface in accordance with a desired image to be transferred to a printing medium P. A protective layer 140 protecting the dielectric layer 134 and the pixel electrodes 136 may be formed on a surface of the capacitor layer 130, i.e., on surfaces of the dielectric layer 134 and the pixel electrodes 136.

Figure 3B:
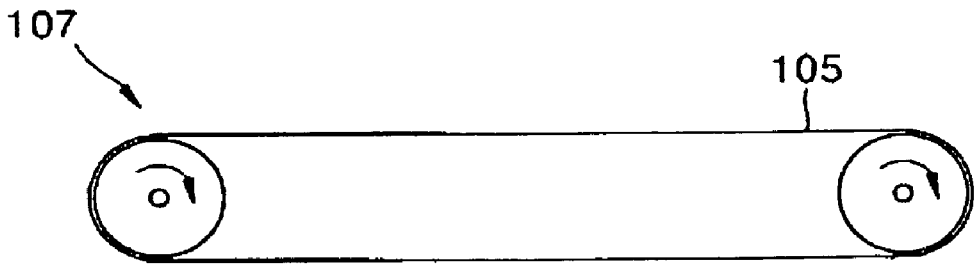
FIG. 3B illustrates a cross-sectional schematic view of a belt as an electrostatic latent image forming medium.

The cross-sectional structure of the electrostatic latent image forming medium will later be described in detail with reference to FIGS. 4-7. Although in the present embodiment, the frame 110 is cylindrical, rendering the electrostatic latent image forming medium in the form of a drum which is rotated around a central axis thereof, a belt 105 circulating along a predetermined path 107 may also be used in place of the cylindrical frame 110 for the electrostatic latent image forming medium, as shown in FIG. 3B. The cross-sectional structure shown with reference to FIGS. 4-7 will be the same for either configuration, although the shape of the frame and the rotational mechanism will be different.

Referring again to FIG. 2, the toner supplying unit supplies toner T to an electrostatic latent image formed on the imaging surface of the rotating drum 100, and develops the electrostatic latent image into a toner image. A variety of devices known to those skilled in the art may be used as the toner supplying unit. For example, a toner supplying roller 150 rotating in contact with the toner T stored in a toner container 152 may be used, as illustrated in FIG. 2. The toner supplying roller 150 adheres the toner T, stored in the toner container 152, to the surface of the rotating drum 100 while rotating in synchronization with the rotating drum 100.

A predetermined potential may be applied to the toner supplying roller 150. Therefore, the toner T adhered to a surface of the toner supplying roller 150 is moved and adhered to an electrostatic latent image on the rotating drum 100 by a difference between a potential of the surface of the toner supplying roller 150 and a potential of the electrostatic latent image.

The transferring unit transfers the developed toner image on the surface of the rotating drum 100 to a printing medium, e.g., a sheet of paper P. A transferring roller 160 may be used as the transferring unit. The transferring roller 160 is disposed parallel to the rotating drum 100 such that it can rotate simultaneously with the rotating drum 100. The sheet of paper P passes between the transferring roller 160 and the rotating drum 100. In this process, the developed toner image on the surface of the rotating drum 100 is transferred to the sheet of paper P.

The transferring unit may include an intermediate transferring belt (not shown). In this case, the developed toner image on the surface of the rotating drum 100 is initially transferred to the intermediate transferring belt. Then, the developed toner image is transferred to the sheet of paper from the intermediate transferring belt by the transferring roller 160. Most image forming apparatuses for printing color images include intermediate transferring belts as transferring units. If an intermediate transferring belt is included in an image forming apparatus, a plurality of drums 100 may be arranged in series along a path of the intermediate transferring belt.

The charging unit charges the surface of the rotating drum 100 with a predetermined potential. A charging roller 170 supplying electric charges to the surface of the rotating drum 100 while rotating in contact with the surface of the rotating drum 100 may be used as the charging unit. Alternatively, a corona wire may be used as the charging unit.

A cleaning unit for removing the toner T remaining on the surface of the rotating drum 100 after the toner image is transferred to the sheet of paper P may be placed near the rotating drum 100. A cleaning blade 180 contacting the surface of the rotating drum 100 may be used as the cleaning unit.

Figure 4:
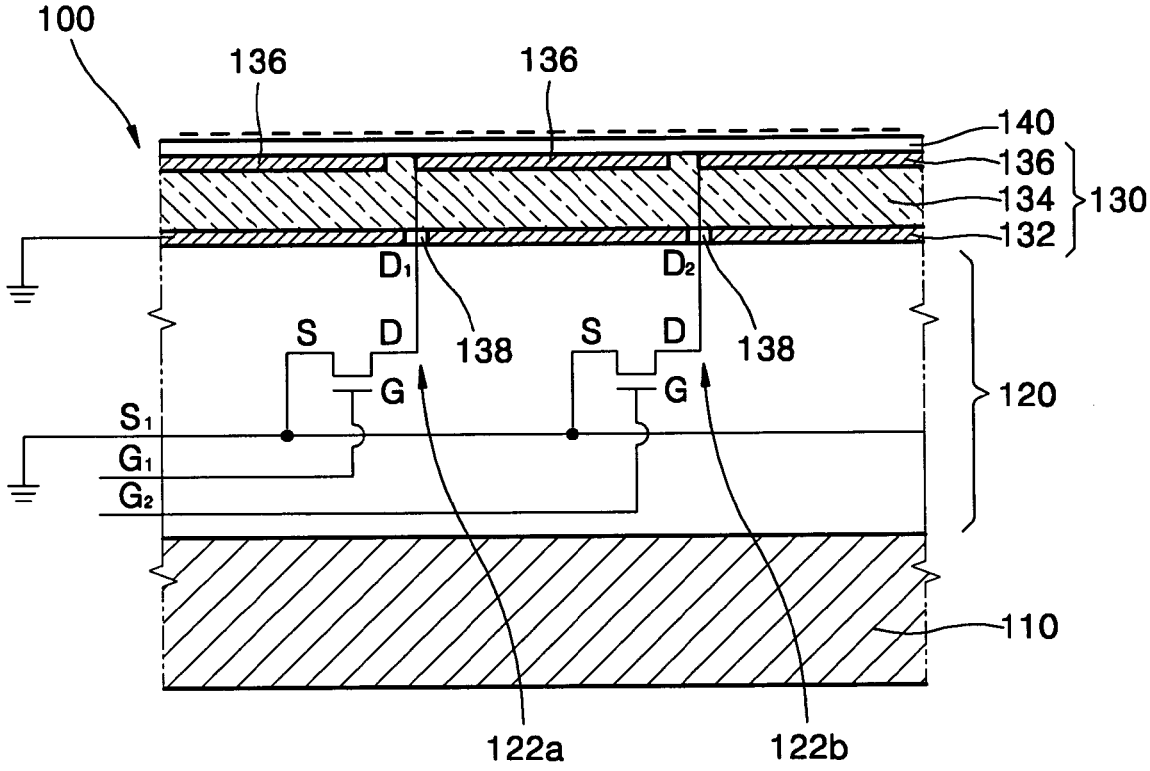
FIGS. 4 and 5 illustrate cross-sectional views of the rotating drum illustrated in FIG. 2 according to an embodiment of the present invention.
Figure 5:
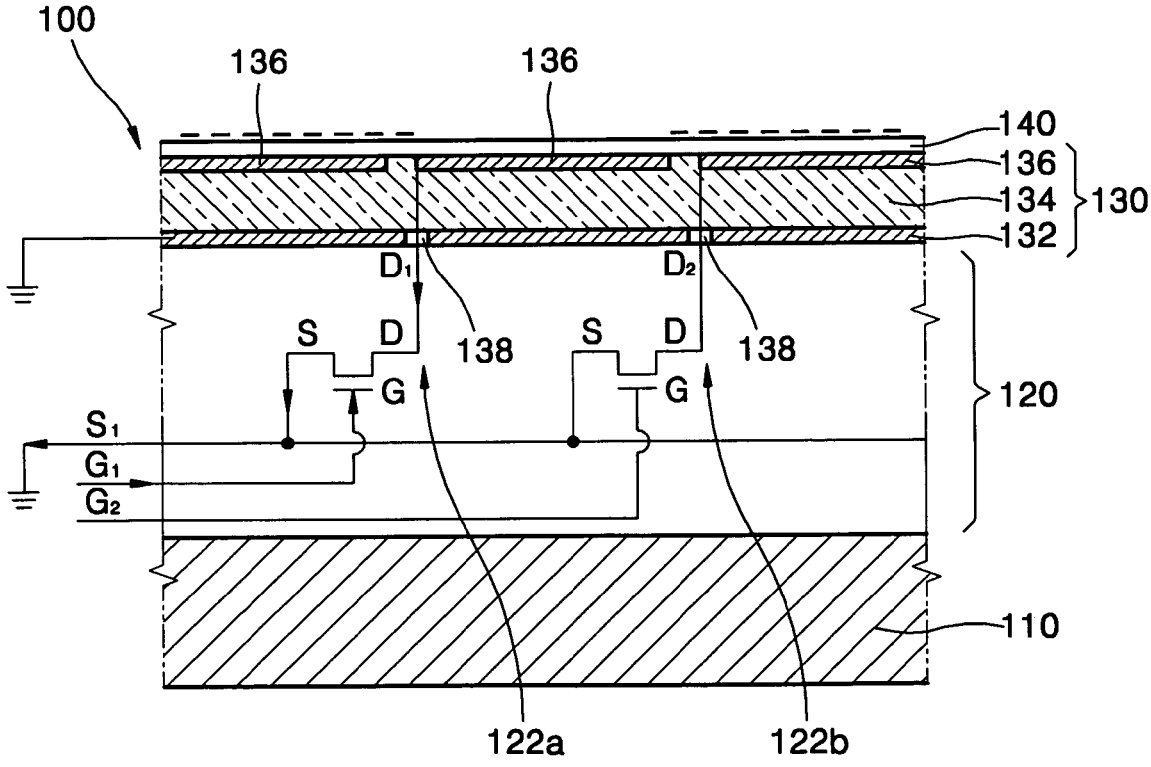

FIGS. 4 and 5 are sectional views of the drum 100 illustrated in FIG. 2 according to an embodiment of the present invention. FIG. 4 illustrates a cross-sectional view of the drum 100 before an electrostatic latent image is formed thereon. FIG. 5 illustrates a cross-sectional view of the drum 100 after an electrostatic latent image is formed thereon. Referring to FIG. 4, the drum 100 includes the frame 110, the TFT array 120, and the capacitor layer 130 stacked sequentially as described above.

The TFT array 120 is stacked on the surface of the frame 110, and includes the TFTs 122*a* and 122*b* arranged, preferably uniformly. The sources S of the TFTs 122*a* and 122*b* are grounded via a source electrode line $S_1$. The gates G of the TFTs 122*a* and 122*b* are connected to gate electrode lines G1 and G2, respectively, such that voltages can be selectively applied to the gates G. The drains D of the TFTs 122*a* and 122*b* are connected to the pixel electrodes 136 via drain electrode lines $D_1$ and $D_2$, respectively.

As described above, the capacitor layer 130 is formed on the TFT array 120, and includes the common electrode 132, the dielectric layer 134, and the pixel electrodes 136 stacked sequentially. The common electrode 132 is grounded and may be formed as a layer covering the entire bottom surface of the dielectric layer 134. A plurality of holes 138 are formed in the common electrode 132 to insulate the common electrode 132 from the drain electrode lines $D_1$ and $D_2$. The pixel electrodes 136 corresponding to pixels, respectively, are formed on the dielectric layer 134 and electrically connected to the drains D of the TFTs 122*a* and 122*b* via the drain electrode lines $D_1$ and $D_2$, respectively.

The protective layer 140 protecting the dielectric layer 134 and the pixel electrodes 136 may be formed on the capacitor layer 130 and may be formed of an abrasion resistant material.

If a circulating belt is used as an electrostatic latent image forming medium, its sectional structure is the same as that of the rotating drum 100 described above.

Hereinafter, a process of forming an electrostatic latent image on the surface of the rotating drum 100 will be described. Referring to FIG. 4, before forming an electrostatic latent image on the surface of the rotating drum 100, the surface of the rotating drum 100 is charged with a predetermined potential using the charging roller 170 of FIG. 2. At this time, voltages are not applied to the gates G of the TFTs 122*a* and 122*b* in the TFT array 120.

FIG. 4 illustrates the rotating drum 100, the surface of which is charged with a negative potential. However, the surface of the drum 100 may be charged with a positive potential. The surface potential of the rotating drum 100 depends on polarity of the potential of the toner T used in an image forming apparatus. In other words, if toner T charged with a negative potential is used, the surface of the rotating drum 100 is also charged with a negative potential. Conversely, if toner T charged with a positive potential is used, the surface of the rotating drum 100 is also charged with a positive potential.

Referring to FIG. 5, voltages are selectively applied to the gates G of the TFTs 122*a* and 122*b*. For example, if a voltage is applied to the gate G of the TFT 122*a* via the gate electrode line G1, as shown in FIG. 5, the source S and the drain D of the TFT 122*a* become electrically connected. Accordingly, electric charges on the surface of the pixel electrode 136 connected to the drain D of the TFT 122*a* drain out via the drain electrode line $D_1$ and the grounded source electrode line $S_1$.

As described above, by selectively addressing the TFTs 122*a* and 122*b*, the surface potential of the rotating drum 100 can be controlled per each pixel electrode 136. Therefore, an electrostatic latent image with a potential different from a potential of its surrounding area is formed on the surface of the rotating drum 100. A difference is formed between a first potential difference, between the electrostatic latent image and the toner supplying roller 150, and a second potential difference, between the surrounding area of the electrostatic latent image and the toner supplying roller 150. Therefore, the toner T with a predetermined potential is adhered only to the electrostatic latent image, thereby forming a toner image.

As described above, according to the present invention, even without using a conventional LSU, an electrostatic latent image can be formed on the surface of the rotating drum 100 using the TFT array 120. Hence, the configuration of the image forming apparatus may be simplified, resulting in a reduction in its size and manufacturing cost. Further, according to the present invention, an entire electrostatic latent image can be formed electrically and substantially simultaneously. Therefore, the image forming apparatus according to the present invention may perform printing at a fast speed, since the time spent on scanning a laser beam, which was previously performed per line, may be reduced or eliminated.

Moreover, since the resolution of a conventional image forming apparatus using an LSU depends on the size of an optical spot, it is difficult to improve the resolution. However, the present invention can achieve high resolution since the pixel electrodes 136 can be formed in a very small size using a micro manufacturing process used in a semiconductor fabrication process.

Figure 6:
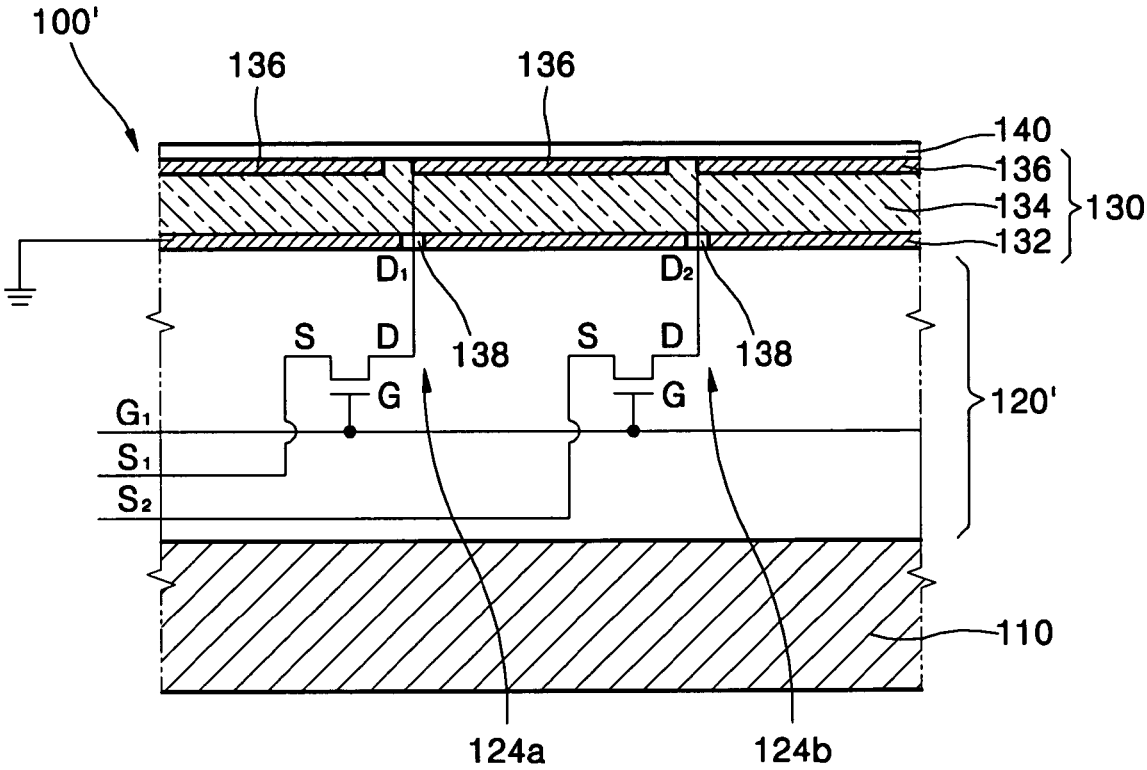
FIGS. 6 and 7 illustrate cross-sectional views of the rotating drum illustrated in FIG. 2 according to another embodiment of the present invention.
Figure 7:
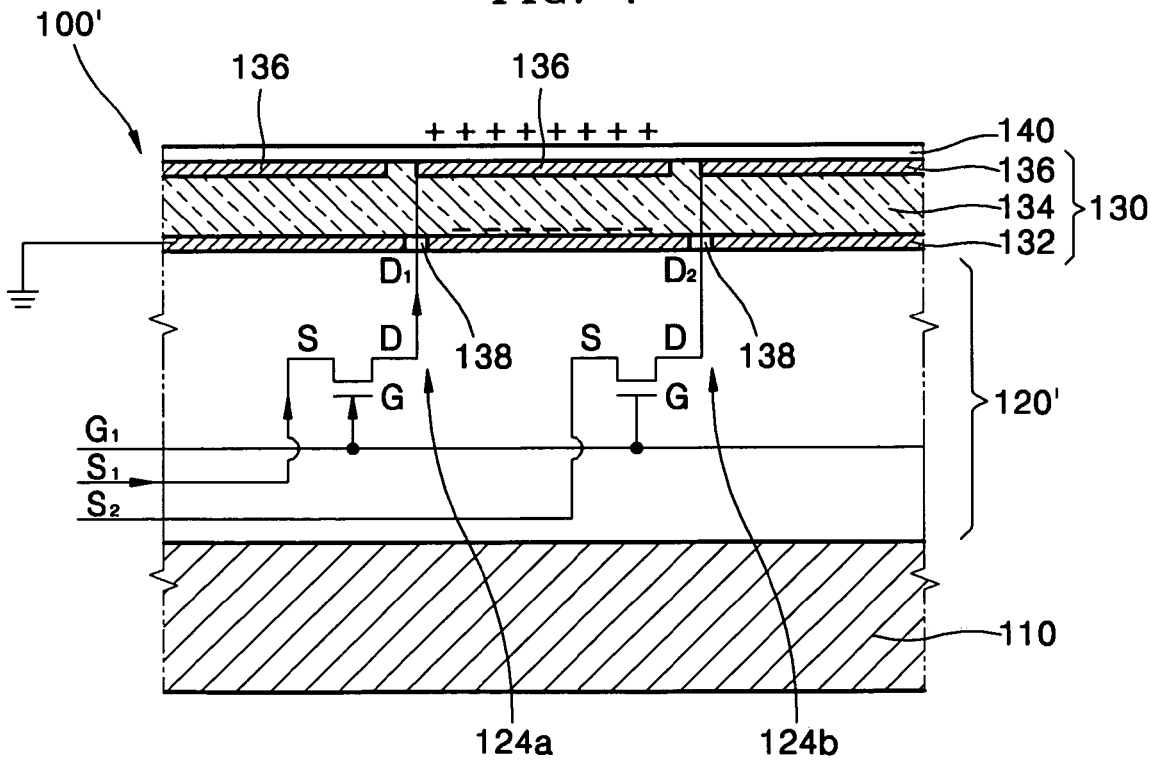

FIGS. 6 and 7 illustrate cross-sectional views of a rotating drum 100' illustrated in FIG. 2 according to another embodiment of the present invention. FIG. 6 illustrates a cross-sectional view of the rotating drum 100' before an electrostatic latent image is formed thereon. FIG. 7 illustrates a cross-sectional view of the rotating drum 100' after an electrostatic latent image is formed thereon. Since the sectional structure of the rotating drum 100' of FIGS. 6 and 7 are identical to that of the rotating drum 100 of FIG. 4 except for wirings of TFTs 124*a* and 124*b*, a detailed description will be focused on the difference between them.

Referring to FIG. 6, the rotating drum 100' includes a TFT array 120' stacked on a surface of a frame 110 and the TFTs 124*a* and 124*b* arranged uniformly in the TFT array 120'.

Voltages are applied to the gates G of the TFTs 124*a* and 124*b* via a common gate electrode line $G_1$. The sources S of the TFTs 124*a* and 124*b* are connected to source electrode lines $S_1$ and $S_2$, respectively, such that voltages can be selectively applied to the sources S. The drains D of the TFTs 124*a* and 124*b* are connected to a plurality of pixel electrodes 136 via drain electrode lines $D_1$ and $D_2$, respectively.

A capacitor layer 130 is stacked on the TFT array 120'. The pixel electrodes 136 formed on the capacitor layer 130 are electrically connected to the drains D of the TFTs 124*a* and 124*b* via the drain electrode lines $D_1$ and $D_2$, respectively.

A process of forming an electrostatic latent image on the surface of the rotating drum 100' with such a sectional structure will now be described. Referring to FIG. 6, since it is not necessary to charge the surface of the rotating drum 100' in advance with a predetermined potential, an image forming apparatus using the rotating drum 100' does not include the charging roller 170 illustrated in FIG. 2.

Referring to FIG. 7, voltages are selectively applied to the gates G and sources S of the TFTs 124*a* and 124*b*. If a voltage is applied to the gate G and the source S of the TFT 124*a*, as shown in FIG. 7, electric charges are injected into the pixel electrode 136 connected to the drain D of the TFT 124*a* via the drain D. The electric charges thus injected are stored in a portion of the capacitor layer 130 corresponding to the pixel electrode 136. Accordingly, the portion storing the electric charges and portions without electric charges coexist on the surface of the rotating drum 100', and these portions have different potentials.

As described above, by injecting electric charges into the pixel electrodes 136 through the selective addressing of the TFTs 124*a* and 124*b*, the surface potential of the rotating drum 100' can be controlled per pixel electrode 136. Therefore, an electrostatic latent image corresponding to an image to be printed can be formed. A difference is formed between a first potential difference, between the electrostatic latent image thus formed and the toner supplying roller 150, and a second potential difference, between the surrounding area of the electrostatic latent image and the toner supplying roller 150. Therefore, the toner T with a predetermined potential is adhered only to the electrostatic latent image, thereby forming a toner image.

As described above, an image forming apparatus according to the present invention forms an electrostatic latent image on a surface of an electrostatic latent image forming medium using a TFT array included in the electrostatic latent image forming medium. Hence, the image forming apparatus may have a simpler configuration than a conventional image forming apparatus, which includes a complicated LSU, resulting in reduced size and manufacturing cost.

Further, according to the present invention, an entire electrostatic latent image can be formed electrically. Therefore, fast printing may be achieved, since time required to scan a laser beam maybe reduced or eliminated.

Moreover, unlike a conventional image forming apparatus whose resolution depends on the size of an optical spot, the image forming apparatus according to the present invention may achieve high resolution by forming a pixel electrode having a very small size, e.g., by using a micro manufacturing process.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An image forming apparatus, comprising:

an electrostatic latent image forming medium including a frame, an imaging surface on which an electrostatic latent image is to be formed, the imaging surface being supported by the frame, and an alteration mechanism for altering the electrostatic latent image on the imaging surface, the alteration mechanism being between the frame and the imaging surface and including a thin film transistor array on a surface of the frame, the thin film transistor array including a plurality of thin film transistors; and a capacitor layer formed on the thin film transistor array, the capacitor layer including a common electrode and a dielectric layer stacked on the common electrode;

a signal supply for supplying a signal to the alteration mechanism in accordance with the electrostatic latent image to be formed; and a transfer unit for transferring the electrostatic latent image to a printing medium.

2. The image forming apparatus as claimed in claim 1, further comprising a charging unit for charging the imaging surface with a predetermined potential.

3. The image forming apparatus as claimed in claim 1, wherein the electrostatic latent image forming medium is a drum.

4. The image forming apparatus as claimed in claim 1, wherein the electrostatic latent image forming medium is a belt.

5. An electrostatic latent image forming medium, comprising:

a frame;

an imaging surface on which an electrostatic latent image is to be formed, the imaging surface being supported by the frame; and an alteration mechanism for altering the electrostatic latent image on the imaging surface, the alteration mechanism being between the frame and the imaging surface and including a thin film transistor array on a surface of the frame, the thin film transistor array including a plurality of thin film transistors; and a capacitor layer formed on the thin film transistor array, the capacitor layer including a common electrode and a dielectric layer stacked on the common electrode.

6. The electrostatic latent image forming medium as claimed in claim 5, wherein the capacitor layer further comprises a plurality of pixel electrodes adjacent to the imaging surface.

7. The electrostatic latent image forming medium as claimed in claim 6, wherein a number of pixel electrodes in the plurality of pixel electrodes corresponds to a desired resolution of the electrostatic latent image.

8. The electrostatic latent image forming medium as claimed in claim 6, wherein the plurality of pixel electrodes is arranged on a surface of the dielectric layer and each pixel electrode is connected to a drain of a corresponding thin film transistor of the plurality of thin film transistors.

9. The electrostatic latent image forming medium as claimed in claim 8, wherein sources of the thin film transistors are grounded.

10. The electrostatic latent image forming medium as claimed in claim 8, wherein the alteration mechanism further comprises a supply line for supplying a voltage to a gate of a thin film transistor to electrically connect a source with a drain of the selected thin film transistor and discharge the pixel electrode connected to the drain of the thin film transistor.

11. The electrostatic latent image forming medium as claimed in claim 8, wherein the alteration mechanism further comprises:

a gate supply line for supplying a gate voltage to a gate of a thin film transistor; and a source supply line for supplying a source voltage to a source of the thin film transistor, the gate and source voltages injecting electric charges to the pixel electrode connected to the drain of the thin film transistor.

12. The electrostatic latent image forming medium as claimed in claim 8, wherein the common electrode is grounded and formed as a layer covering an entire bottom surface of the dielectric layer.

13. The electrostatic latent image forming medium as claimed in claim 8, further comprising a protective layer on a surface of the capacitor layer.

14. The electrostatic latent image forming medium as claimed in claim 13, wherein the protective layer is formed of an abrasion resistant material.

15. The electrostatic latent image forming medium as claimed in claim 5, wherein the frame is cylindrical.

16. The electrostatic latent image forming medium as claimed in claim 5, wherein the frame is a belt.

17. A method of forming an image, comprising:

charging an image forming apparatus imaging surface with a potential via a charge roller;

selectively controlling the potential of selected pixel electrodes of a plurality of pixel electrodes, the plurality of pixel electrodes under an imaging surface on which an electrostatic latent image is to be formed such that the potential of the selected pixel electrodes is different than the potential of the imaging surface, the selectively controlling being in accordance with the electrostatic latent image to be formed; and transferring the electrostatic image to a printing medium.

18. The method of forming an image as claimed in claim 17, further comprising charging the imaging surface with a positive potential before selectively controlling the potential.

19. The method of forming an image as claimed in claim 18, wherein the selectively controlling the potential includes discharging the selected pixel electrodes.

20. The method of forming an image as claimed in claim 17, further comprising charging the imaging surface with a negative potential before selectively controlling the potential, wherein the selectively controlling the potential includes charging the selected pixel electrodes.

* * * * *